US006418915B1

(12) United States Patent
Harrigan, Sr.

(10) Patent No.: US 6,418,915 B1
(45) Date of Patent: Jul. 16, 2002

(54) FUEL VAPOR EMISSION CONTROL SYSTEM EMPLOYING VACUUM

(75) Inventor: Michael Joseph Harrigan, Sr., Ann Arbor, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/634,618

(22) Filed: Aug. 5, 2000

(51) Int. Cl.[7] ..... F02M 33/02
(52) U.S. Cl. ..... 123/520; 123/198 D
(58) Field of Search ..... 123/198 D, 516, 123/518, 519, 520, 521

(56) References Cited

U.S. PATENT DOCUMENTS

| | | | | | |
|---|---|---|---|---|---|
| 3,937,198 | A | | 2/1976 | Sudhir | 123/520 |
| 5,174,265 | A | * | 12/1992 | Sekine | 123/520 |
| 5,220,898 | A | * | 6/1993 | Kidokoro et al. | 123/520 |
| 5,235,955 | A | * | 8/1993 | Osaki | 123/520 |
| 5,441,031 | A | * | 8/1995 | Kiyomiya et al. | 123/518 |
| 5,456,238 | A | | 10/1995 | Horiuchi et al. | 123/520 |
| 5,603,349 | A | * | 2/1997 | Harris | 137/588 |
| 5,617,832 | A | | 4/1997 | Yamazaki et al. | 123/520 |
| 5,809,976 | A | * | 9/1998 | Cook et al. | 123/516 |
| 5,878,727 | A | * | 3/1999 | Huls | 123/520 |
| 6,029,635 | A | * | 2/2000 | Sekine et al. | 123/516 |
| 6,158,270 | A | * | 12/2000 | Garman et al. | 73/40.7 |
| 6,167,920 | B1 | * | 1/2001 | Enge | 141/5 |
| 6,260,544 | B1 | * | 7/2001 | Spry et al. | 123/516 |

FOREIGN PATENT DOCUMENTS

| | | |
|---|---|---|
| JP | 4-124449 | 4/1992 |

* cited by examiner

*Primary Examiner*—Tony M. Argenbright
*Assistant Examiner*—Hai Huynh
(74) *Attorney, Agent, or Firm*—Carlos L. Hanze

(57) ABSTRACT

A fuel system and a method for refueling a fuel tank within the fuel system both employ a fuel tank having contained therein a fuel vapor, where the fuel tank also has a refueling detection device which is activated incident to refueling the fuel tank with a liquid fuel. The fuel system and the method for refueling the fuel tank also employ a fuel vapor valve which is activated by the refueling detection device, wherein: (1) the fuel vapor valve directs the fuel vapor from the fuel tank to a first fuel vapor conduit connected to a fuel vapor absorption device when the refueling detection device is activated; and (2) the fuel vapor valve directs the fuel vapor from the fuel tank to a second fuel vapor conduit connected to an engine which is powered by the liquid fuel when the refueling detection device is not activated.

6 Claims, 1 Drawing Sheet

FUEL VAPOR EMISSION CONTROL SYSTEM EMPLOYING VACUUM

BACKGROUND OF THE INVENTION

1. Field of the Invention

The present invention relates generally to fuel vapor emission control for fuel systems in vehicles with internal combustion engines. More particularly, the present invention relates to fuel tank fuel vapor emission control in such vehicles.

2. Description of the Related Art

Modern transportation vehicles which employ a liquid fuel for internal combustion engines conventionally also employ for storage of the liquid fuel a fuel tank. Similarly, since most liquid fuels are highly volatile, such a fuel tank typically contains in addition to the liquid fuel a fuel vapor. A concentration of fuel in the fuel vapor within the fuel tank is generally related to the temperature of the liquid fuel and the temperature of the fuel vapor.

While the fuel vapor within a fuel tank does not typically impair operation of a transportation vehicle powered by an engine which employs a liquid fuel extracted from the fuel tank, upon refueling of the fuel tank with additional liquid fuel the fuel vapor must of necessity be displaced. For environmental protection purposes and for economic reasons, it is desirable for such displaced fuel vapor not to be released into the atmosphere.

Various apparatus, systems and methods have been disclosed within the art of fuel system design for attenuating, upon refueling of a fuel tank, release of fuel vapor into the atmosphere. Well known in this regard are fuel system designs which incorporate the use of carbon filled canisters for cyclical absorptive capture and desorptive controlled release of fuel vapor displaced incident to refueling of a fuel tank. Examples of such fuel system designs are disclosed within U.S. Pat. No. 3,937,198, U.S. Pat. No. 5,456,238, U.S. Pat. No. 5,617,832 and Japan No. 4-124,449, all of which are incorporated herein fully by reference.

While any of the disclosed fuel system designs provides upon refueling of a fuel tank and during operation of the vehicle between refueling with a liquid fuel an attenuated displaced fuel vapor release into the atmosphere, such desirable result is often achieved only with complicated piping and valving schemes. In addition, carbon canisters have limited capacity for attenuating vapor release between refuelings.

There thus exists within the art of fuel tank design and fuel system design a continuing need for comparatively simple apparatus, systems and methods for attenuating release of a displaced or evolved fuel vapor into the atmosphere. It is towards that object that the present invention is directed.

SUMMARY OF THE INVENTION

In order to realize the object towards which the present invention is directed, the present invention provides in the first instance a fuel system comprising a fuel tank within which is contained a fuel vapor. The fuel tank is also fabricated to have a refueling detection means which is activated incident to refueling the fuel tank with a liquid fuel. The fuel system also has a fuel vapor valve which is activated by the refueling detection means, wherein: (1) the fuel vapor valve directs the fuel vapor displaced from the fuel tank to a first fuel vapor conduit connected to a fuel vapor absorption means when the refueling detection means is activated; and (2) the fuel vapor valve directs the fuel vapor from the fuel tank to a second fuel vapor conduit connected to an engine which is powered by the liquid fuel when the refueling detection means is not activated. Within the present invention, the second fuel vapor conduit does not incorporate a fuel vapor absorption means, in particular as interposed between the fuel vapor valve and the engine.

BRIEF DESCRIPTION OF THE DRAWINGS

The objects, features and advantages of the present invention are understood within the context of the Description of the Preferred Embodiment, as set forth below. The Description of the Preferred Embodiment is understood within the context of the accompanying drawing, which forms a material part of this disclosure, wherein.

DESCRIPTION OF THE PREFERRED EMBODIMENT

Figure 1:
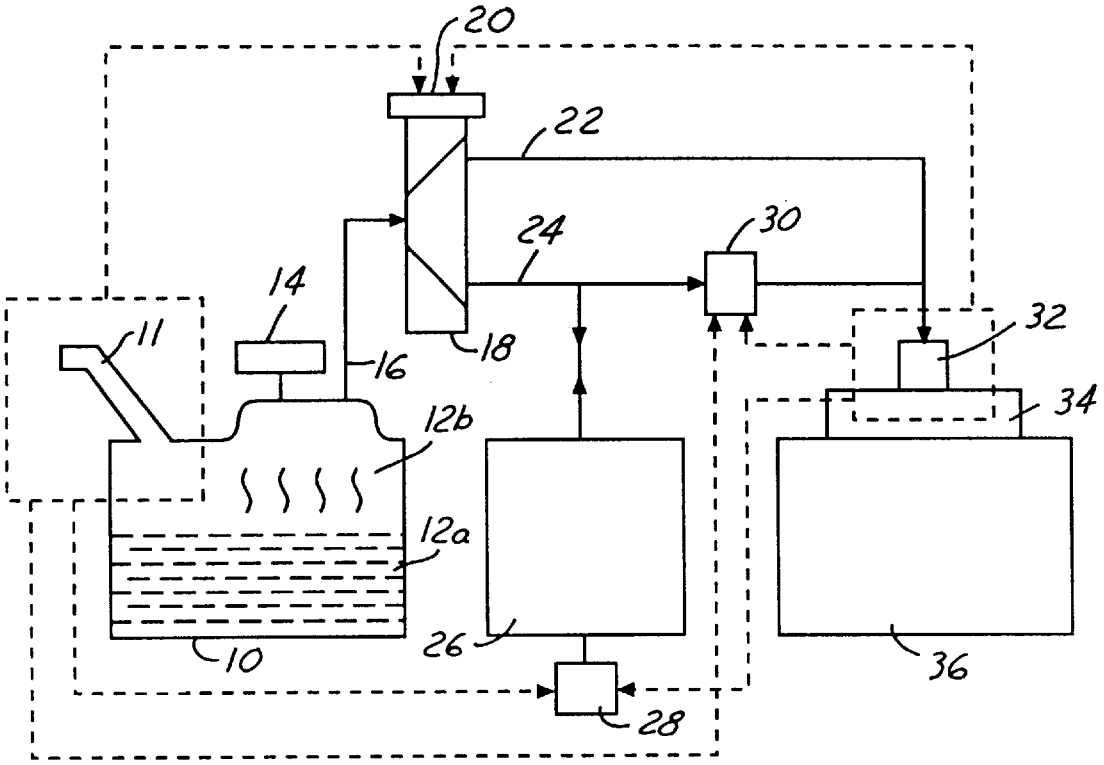
FIG. 1 shows a schematic diagram of a fuel system fabricated in accord with a preferred embodiment of the invention.

Referring now to FIG. 1, there is shown a schematic diagram of a fuel system fabricated in accord with a preferred embodiment of the present invention.

Shown in FIG. 1 is a fuel tank 10 having formed integral thereto, as illustrated within a phantom outline which includes a portion of the fuel tank 10, a fuel filler pipe 11. Also shown within FIG. 1 contained within the fuel tank 10 is a liquid fuel 12*a* and a fuel vapor 12*b*. Similarly, there is also shown in FIG. 1 connected to the top of the fuel tank 10 a vacuum release valve 14. Finally, there is also shown within FIG. 1, and also connected to the top of the fuel tank 10, a fuel vapor vent conduit 16 intended to convey upon refueling of the fuel tank 10 with an additional quantity of a liquid fuel, such as the liquid fuel 12*a*, the fuel vapor 12*b* from the fuel tank 10 to a fuel vapor valve 18.

Within the preferred embodiment of the present invention with respect to the fuel vapor valve 18, the fuel vapor valve 18 upon actuation with an actuator 20 which is connected to the fuel vapor valve 18 provides an option of directing the fuel vapor 12*b* from the fuel tank 10 through either: (1) a second fuel vapor conduit 22 which leads directly to a mass flow monitor/controller 32 which is connected to an intake manifold 34 which in turn is connected to an engine 36 which is otherwise fueled with the liquid fuel 12*a* when extracted from the fuel tank 10, or in the alternative; (2) a first fuel vapor conduit 24 which has a bifurcated connection leading to either: (a) a fuel vapor absorption canister 26 which in turn has connected thereto a cutoff valve 28; or (b) a throttle/cutoff valve 30 which may be employed for impeding or eliminating flow of the fuel vapor 12*b* through the second fuel vapor conduit 24 prior to reaching the mass flow monitor/controller 32 which is connected to the intake manifold 34 which in turn is connected to the engine 36.

While FIG. 1 illustrates in static format a schematic diagram of a fuel system in accord with the preferred embodiment of the present invention, it is also significant to describe within the context of the present invention and the preferred embodiment of the present invention the dynamics of operation of the fuel system of the preferred embodiment of the present invention, as illustrated within the schematic diagram of FIG. 1. To assist in that goal, there is also illustrated within the schematic diagram of FIG. 1 several phantom lines which assist in illustrating operation of the fuel system of the preferred embodiment of the present invention.

In that regard, there is shown in FIG. 1, in a first instance, and in phantom, a rectangular enclosure which includes the fuel filler pipe 11 of the fuel tank 10. Although not specifically illustrated within the schematic diagram of FIG. 1, the rectangular enclosure which includes the fuel filler pipe 11 of the fuel tank 10 is intended to indicate that there exists a refilling detection means which is activated incident to an event which is related to refueling of the fuel tank 10 with an additional quantity of a liquid fuel, such as the liquid fuel 12*a*. The refueling detection means may comprise, but is not limited to, a switch or a sensor as is otherwise generally conventional in the art of fuel system fabrication. The particular refueling event which may be employed to trigger the refueling detection means may be selected from the group including but not limited to a fuel filler door opening refueling event, a fuel filler pipe cap removal refueling event or an actual physical introduction of the additional quantity of the liquid fuel into the fuel tank 10 as a refueling event. Within the present invention and the preferred embodiment of the present invention, the refueling detection means actuates the actuator 20 and the fuel vapor valve 18 independent of whether the engine 36 is operating.

Although not specifically completely illustrated within the schematic diagram of FIG. 1, upon actuation of the refueling detection means, the actuator 20 actuates the fuel vapor valve 18 in a fashion such that the fuel vapor 12*b* which upon refueling is displaced from the fuel tank 10 is directed into the first fuel vapor conduit 24. Similarly, the refueling detection means also actuates the throttle/cutoff valve 30 to a completely closed position such that all of the fuel vapor 12*b* displaced from the fuel tank 10 upon refueling of the fuel tank 10 is directed through the fuel vapor absorption canister 26, which is typically and preferably filled with a carbon absorbent material, although other organic and inorganic absorbent materials may also be employed within the fuel vapor absorption canister 26. Finally, during periods of refueling, the refueling detection means also assures that the cutoff valve 28 which is connected to the fuel vapor absorption canister 26 is open, such that a purge of the fuel vapor 12*b* through the fuel vapor absorption canister 26 may be fully and completely effected.

In contrast, under circumstances where the engine 36 is operating and the fuel tank 10 is not being refueled, a secondary set of controls, which derives in part from the mass flow monitor/controller 32, controls various of the valves as illustrated within the fuel system whose schematic diagram is illustrated in FIG. 1. In that regard, the mass flow monitor/controller 32 provides control over: (1) the fuel vapor valve 18 which is relocated to a position which connects the fuel vapor vent conduit 16 with the second fuel vapor conduit 22 (or in the adjunct or alternative over an additional fuel vapor valve disposed within the second fuel vapor conduit 22 downstream of the fuel vapor valve 18); and (2) the throttle/cutoff valve 30, such that an appropriate amount of fuel vapor 12*b* is introduced into the intake manifold 34 from purging of each of the fuel tank 10 and the fuel vapor absorption canister 26. Thus, it is generally intended within the present invention and the preferred embodiment of the present invention that under circumstances other than refueling of the fuel tank 10, and when the engine 36 is operating, that the fuel tank 10 is maintained at a negative pressure which draws fuel vapor 12*b* from the fuel tank 10 into the intake manifold 34. Similarly, it is also generally intended within the present invention and the preferred embodiment of the present invention that the fuel vapor absorption canister 26 not breathe with respect to the fuel tank, but rather only capture displaced fuel vapor 12*b* when the fuel tank 10 is refueled and desorb such captured displaced fuel vapor 12*b* to the engine 36 when the engine 36 is operating and the fuel tank 10 is not being refueled. Finally, the mass flow monitor/controller 32 also assures that the cutoff valve 28 is completely open when the engine 36 is operating in order to assure for complete and effective purging of absorbed fuel vapor 12*b* from the fuel vapor absorption canister 26.

Finally, under circumstances when the engine 36 is not operating and thus neither liquid fuel 12*a* nor the fuel vapor 12*b* is being consumed, and further when the fuel tank 10 is not being refueled: (1) the cutoff valve 28 to the fuel vapor absorption canister 26 is closed; and (2) the fuel vapor valve 18 is actuated to a neutral position which seals the fuel vapor vent conduit 16, thus providing, at least initially, the fuel tank 10 at a negative pressure. The pressure of the fuel vapor 12*b* within the fuel tank 10 will then be controlled at a lower level by the vacuum release valve 14 (which is typically fabricated to provide a vacuum release at about 5.0 pounds per square inch within the fuel tank 10. Similarly, the pressure of the fuel vapor 12*b* within the fuel tank 10 will than be controlled at an upper level by a diurnal temperature variation or other unexpected temperature excursion of the liquid fuel 12*a* and the fuel vapor 12*b* within the fuel tank. Within the context of most foreseeable temperature excursions, it is expected that the upper level of fuel vapor 12*b* pressure within the fuel tank 10 is unlikely to exceed about 3.5 pounds per square inch.

Upon fabrication of a fuel system in accord with the fuel system whose schematic diagram is illustrated in FIG. 1, there is provided a fuel system of comparatively simple design which further provides for attenuated release into the atmosphere of a fuel vapor when refueling with a liquid fuel a fuel tank which comprises a portion of the fuel system.

As is understood by a person skilled in the art, the preferred embodiment of the present invention is illustrative of the present invention rather than limiting of the present invention. Revisions and modifications may be made to methods, materials, structure and dimensions through which is fabricated a fuel system in accord with the preferred embodiment of the present invention, while still fabricating a fuel system in accord with the present invention, further in accord with the appended claims.

What is claimed is:

1. A fuel system comprising:

a fuel tank having contained therein a fuel vapor, the fuel tank also having a refueling detection means which is activated incident to refueling the fuel tank with a liquid fuel;

a fuel vapor valve which is activated by the refueling detection means, wherein:

the fuel vapor valve directs the fuel vapor from the fuel tank to a first fuel vapor conduit connected to a fuel vapor absorption means when the refueling detection means is activated; and the fuel vapor valve directs the fuel vapor from the fuel tank to a second fuel vapor conduit not connected to a fuel vapor absorption means, but connected to an engine which is powered by the liquid fuel, when the refueling detection means is not activated.

2. The fuel system of claim 1 wherein the refueling detection means is triggered by a refueling event selected from the group consisting of a fuel filler door opening refueling event, a fuel cap removal refueling event and introduction of the liquid fuel into the fuel tank as a refueling event.

3. The fuel system of claim 1 wherein the fuel tank is maintained under a vacuum from the engine when the engine is operating and the fuel tank is not being refueled.

4. A method for refueling a fuel tank comprising:

providing a fuel tank having contained therein a fuel vapor, the fuel tank also having a refueling detection means which is activated incident to refueling the fuel tank with a liquid fuel;

activating by means of the refueling detection means a fuel vapor valve, wherein:

the fuel vapor valve directs the fuel vapor from the fuel tank to a first fuel vapor conduit connected to a fuel vapor absorption means when the refueling detection means is activated; and the fuel vapor valve directs the fuel vapor from the fuel tank to a second fuel vapor conduit not connected to a fuel vapor absorption means, but connected to an engine which is powered by the liquid fuel, when the refueling detection means is not activated.

5. The method of claim 4 wherein the refueling detection means is triggered by a refueling event selected from the group consisting of a fuel filler door opening refueling event, a fuel cap removal refueling event and introduction of the liquid fuel into the fuel tank as a refueling event.

6. The method of claim 4 wherein the fuel tank is maintained under a vacuum from the engine when the engine is operating and the fuel tank is not being refueled.

* * * * *